US011992140B2

(12) United States Patent
Carter

(10) Patent No.: US 11,992,140 B2
(45) Date of Patent: May 28, 2024

(54) YOGA TOWEL

(71) Applicant: Christi Carter, Palm Beach Gardens, FL (US)

(72) Inventor: Christi Carter, Palm Beach Gardens, FL (US)

( * ) Notice: Subject to any disclaimer, the term of this patent is extended or adjusted under 35 U.S.C. 154(b) by 0 days.

(21) Appl. No.: 17/977,196

(22) Filed: Oct. 31, 2022

(65) Prior Publication Data

US 2023/0052795 A1 Feb. 16, 2023

Related U.S. Application Data

(60) Division of application No. 16/008,622, filed on Jun. 14, 2018, now Pat. No. 11,484,141, which is a (Continued)

(51) Int. Cl.
*A47G 27/02* (2006.01)
*A44B 99/00* (2010.01)
(Continued)

(52) U.S. Cl.
CPC ..... *A47G 27/0231* (2013.01); *A44B 99/00* (2013.01); *A47G 9/062* (2013.01);
(Continued)

(58) Field of Classification Search
CPC ..... A47G 9/062; A47G 9/06; A47G 27/0212; A47G 27/0231; A47G 27/0237;
(Continued)

(56) References Cited

U.S. PATENT DOCUMENTS 7,178,185 B1 * 2/2007 Nattler ..... A41D 15/04 2/84
7,624,460 B2 * 12/2009 Maimone ..... A47G 9/0261 5/501

(Continued)

FOREIGN PATENT DOCUMENTS

AU 2021107648 A4 * 1/2022 ..... A44B 99/00
CA 3008624 A1 * 6/2017 ..... A44B 99/00

(Continued)

OTHER PUBLICATIONS

Examination Report dated Mar. 27, 2023 in European Application No. 16 876 551.9.

(Continued)

*Primary Examiner* — Robert G Santos
(74) *Attorney, Agent, or Firm* — Stephen J. Weyer, Esq.; Stites & Harbison, PLLC

(57) ABSTRACT

A yoga towel is for use in conjunction with a suitable mat or converter that allows an existing mat to be retrofitted to be used with the present yoga towel. The yoga towel has one or more magnets and/or metal attached, advantageously to its perimeter and/or with a center portion of the towel. A suitable surface such as a yoga mat will have a complementary metal and/or magnet so that when the yoga towel is placed on the yoga mat, the yoga towel through magnetic forces (i.e. attraction) is held in place. Advantageously, in one form, the magnets and/or metal are strips in the yoga towel and/or yoga mat are in the form of flexible strips of magnetic material and/or metal.

8 Claims, 9 Drawing Sheets

Related U.S. Application Data continuation-in-part of application No. PCT/US2016/066585, filed on Dec. 14, 2016.

(60) Provisional application No. 62/266,825, filed on Dec. 14, 2015.

(51) Int. Cl.

| | |
|---|---|
| ***A47G 9/06*** | (2006.01) |
| ***A47G 27/04*** | (2006.01) |
| ***A63B 21/00*** | (2006.01) |
| ***A63B 71/00*** | (2006.01) |

(52) U.S. Cl.

CPC ..... *A47G 27/0237* (2013.01); *A47G 27/04* (2013.01); *A47G 27/0412* (2013.01); *A63B 21/4037* (2015.10); *A63B 71/00* (2013.01); *A44D 2203/00* (2013.01); *A47G 9/06* (2013.01); *A47G 27/0212* (2013.01); *A47G 2200/106* (2013.01); *A63B 2209/08* (2013.01)

(58) Field of Classification Search

CPC ..... A47G 27/04; A47G 27/0412; A63B 21/4037; A63B 71/00; A44B 99/00

USPC ..... 5/420, 417, 693, 906

See application file for complete search history.

(56) References Cited

U.S. PATENT DOCUMENTS

| | | | | |
|---|---|---|---|---|
| 7,955,683 | B1 * | 6/2011 | Ferrell | A63B 57/60 15/209.1 |
| 9,610,472 | B2 * | 4/2017 | Willis | A63B 21/4037 |
| 11,484,141 | B2 * | 11/2022 | Carter | A47G 27/0412 |
| 2007/0225124 | A1 | 9/2007 | Cabados | |
| 2007/0287002 | A1 | 12/2007 | Cabados | |
| 2009/0126111 | A1 * | 5/2009 | Maimone | A47G 9/0261 5/485 |
| 2013/0260076 | A1 * | 10/2013 | Hejazifar | A47G 9/0253 5/490 |
| 2014/0026321 | A1 * | 1/2014 | Lyons | A47G 9/023 5/502 |
| 2014/0068858 | A1 * | 3/2014 | Wambeke | A47G 9/062 5/420 |
| 2014/0182060 | A1 * | 7/2014 | Mikkelsen | A47C 21/026 5/400 |
| 2015/0243185 | A1 | 8/2015 | Purdy | |
| 2015/0374136 | A1 * | 12/2015 | Mikkelsen | A47C 21/044 5/411 |
| 2016/0059066 | A1 * | 3/2016 | Willis | A63B 21/4037 5/417 |
| 2018/0296014 | A1 * | 10/2018 | Carter | A63B 71/00 |
| 2023/0052795 | A1 * | 2/2023 | Carter | A63B 71/00 |

FOREIGN PATENT DOCUMENTS

| | | | | |
|---|---|---|---|---|
| CN | 202355756 | | 8/2012 | |
| CN | 204352439 | | 5/2015 | |
| DE | 20013553 | | 2/2001 | |
| DE | 202010016356 | | 3/2011 | |
| WO | WO-2017106297 | A1 * | 6/2017 | A44B 99/00 |

OTHER PUBLICATIONS

Office Action dated Jan. 11, 2023 in Canadian Application No. 3,008,624.

Examination Report dated Jul. 13, 2022 in European Application No. 16 876 551.9.

Examination Report dated Aug. 28, 2023 in European Application No. 16 876 551.9.

* cited by examiner

YOGA TOWEL

CROSS REFERENCE TO RELATED APPLICATIONS

This application is a divisional of U.S. patent application Ser. No. 16/008,622 which issued as U.S. Pat. No. 11,484,141 on Nov. 1, 2022; which was a continuation-in-part of PCT/US2016/066585 filed Dec. 14, 2016 which; in turn, claims the benefit of U.S. Provisional Patent Application No. 62/266,825, filed on Dec. 14, 2015, both herein incorporated by reference.

FIELD OF THE INVENTION

The present invention relates to a yoga towel and in particular a yoga towel for use with a suitable yoga mat configured to advantageously provide a slip resistant towel arrangement with the yoga mat. The yoga mat can be one specifically designed to be used with the present yoga mat or a convention yoga mat can be adapted via a converter that allows the conventional yoga mat to be retrofitted.

BACKGROUND OF THE INVENTION

Yoga towels are used during yoga exercises. Often the yoga towel is used in conjunction with a yoga mat. Yoga towels are especially beneficial for use during yoga that is performed vigorously or in heated environments or classes. The yoga towel absorbs sweat to prevent the yoga mat from becoming wet with perspiration and to help the participant, i.e. yogi, maintain a preferred grip. Further, the yoga towel prevents the yogi from slipping. In addition, the towel can be easily cleaned by washing the towel to keep both the towel as well as the yoga mat hygienic.

One disadvantage with current yoga towels is that during use, the towel will move as the yogi is preforming yoga exercises. Often the towel will "bunch up" and wrinkle resulting in a non-ideal surface upon which to perform yoga. Further, one must readjust the towel during yoga exercises.

SUMMARY OF THE INVENTION

The present invention is directed to a yoga towel which is used in conjunction with a suitable mat or converter that allows an existing mat to be retrofitted to be used with the present yoga towel. The yoga towel has one or more magnets and/or metal attached, advantageously to its perimeter. A suitable surface such as a yoga mat will have a complementary metal and/or magnet so that when the yoga towel is placed on the yoga mat, the yoga towel through magnetic forces (i.e. attraction) is held in place. Further, advantageously, in one form, the magnets and/or metal are strips of the yoga towel and/or yoga mat are in the form of flexible strips of magnetic material and/or metal.

In one further advantageous form, the magnets and/or metal are completely enclosed within fabric material of the towel or a separate piece of material such as a piece of fabric is disposed over the metal or magnets such that the fabric material of the towel or the separate piece of material completely encloses the metallic members within the towel.

As a result, there is no exposed metal or magnets. In one specific advantageous form, separate pieces of material, such as fabric, are bonded to the towel over the magnets or metal whereby the metallic members are completely enclosed between the separate pieces of material and the fabric material of the towel. The metallic members may also be bonded to the towel, themselves.

In various forms, the yoga towel can include one or more magnets and the yoga mat includes magnets of opposite polarity to those in the yoga towel. Alternatively, the yoga towel can include one or more magnets or strips and the yoga mat has a suitable metal to which one or more magnets in the yoga towel attract. In yet another alternative, the yoga towel may have one or more pieces of metal or magnetic strips to which magnets in the yoga mat are attracted. In one specific advantageous form, the metal and/or magnets are coated with a waterproof material such as a plastic rubber coating.

The present invention, in one form thereof, relates to a towel for use with a complementary mat with permanently attached metal or magnet. The towel is composed of a fabric material. One or more towel metallic members are ferromagnetic or magnetized and disposed within the fabric material of the towel or covered with a separate piece of material so that the fabric material of the towel or the separate piece of material completely encloses the one or more metallic members within the towel and/or separate piece of material. The towel metallic member is complementarily ferromagnetic or magnetized to be attracted to the metal or magnet permanently attached to the yoga mat. The towel, when placed on the yoga mat, is held in place due to magnetic attraction between the towel magnetic member and the metal or magnet attached to the yoga mat.

The present yoga towel in one further alternative form has the towel magnetic member comprising a metallic strip that extends adjacent a perimeter of at least one of four edges of a rectangular towel. In one advantageous further form, the magnetic strip extends adjacent a perimeter of all four edges of the rectangular towel.

The towel magnetic member may be joined to the towel by having a perimeter of the towel folded back on itself forming a pocket and the towel magnetic member being disposed within the pocket. The pocket may be closed by stitching or adhering the folded perimeter of the towel to a remaining portion of the towel. Alternatively, a separate piece of material may be joined to the towel over the metallic or magnetic member using a bonding adhesive so that the separate piece of material is bonded on all edges around the metallic member, completely enclosing the metallic member between the separate piece of material and the towel itself.

The present invention, in another form thereof, relates to a yoga mat which comprises a mat substrate. The mat substrate has a top surface, bottom surface and perimeter sides spanning the top surface and bottom surface defining an interior. A metal or magnet is permanently fixed to the mat proximate at least one of the top surface and perimeter sides. The metal or magnet is (1) disposed within material of the mat so as to completely enclose the metal or magnets within the mat, (2) disposed on one of the perimeter sides between the top surface and the bottom surface and held in place using a clip, thereby fixing the metal or magnet to the mat or (3) on a top surface of the mat and covered with a strip of material to thereby with the mat, completely enclose the metal or magnet. When a fabric towel with towel metallic member comprising ferromagnetic or magnetized metal is physically joined to the yoga mat, the fabric towel is held in place when disposed on the mat due to magnetic attraction between the metal or magnet or mat and the towel metallic member(s).

In one further form of the yoga mat, the metal or magnet is disposed on a top surface of the mat substrate and the yoga mat further comprises a strip of material, such as fabric, over the metal or magnet(s) and the strip of metal is then adhered to a remaining portion of the top surface of the mat and at least one of the sides and/or the bottom surface of the mat, to thereby fix the metal or magnet permanently to the mat.

In one further form, the strip is a piece of fabric stitched or adhesively joined to the mat.

In one alternative further form, the metal or magnet is disposed on the top surface of the mat substrate and the yoga mat further comprises a clip disposed over the metal or magnet(s) and clipped to a perimeter of the mat, between the top surface and the bottom surface.

The present invention in another further embodiment includes the metal or magnet(s) which extends adjacent a perimeter of at least one of the sides or edges of the mat.

In yet another further alternative form the yoga mat has metal or magnetic extending adjacent a perimeter of four edges of a rectangular mat.

In one further alternative form, the yoga mat further includes a foam layer on the mat substrate having a recess into which the metal or magnet is disposed. In yet a further form, the yoga mat further has a top layer on the foam layer.

The present invention, in another form thereof, relates to a yoga towel and mat system. The system comprises a yoga mat and a complementary yoga towel. The mat comprises a mat substrate having a top surface, bottom surface, and perimeter sides and a metal or magnet permanently fixed to the mat proximate at least the top surface and/or perimeter sides. The yoga towel comprises a fabric towel and a towel metallic member which his ferromagnetic or magnetized, disposed within the fabric material of the towel or covered with a separate piece of material so that the fabric of the towel or the separate piece of material with the fabric of the towel, completely encloses the metallic members within the towel. The towel metallic member is complementarily ferromagnetic or magnetized to be attracted to the metal or magnet permanently affixed to the yoga mat. The fabric towel is held in place due to the magnetic attraction between the towel metallic member and the metal or magnet affixed to the yoga mat.

DETAILED DESCRIPTION

The present invention is directed to a yoga towel for use with a suitable yoga mat in which the yoga towel is held in place due to magnetic attraction, also known as magnetic force, between elements in the yoga towel and the yoga mat. The yoga mat can be a specifically designed yoga mat or a conventional yoga mat which has been retrofitted to be used with the present yoga towel.

Figure 1:
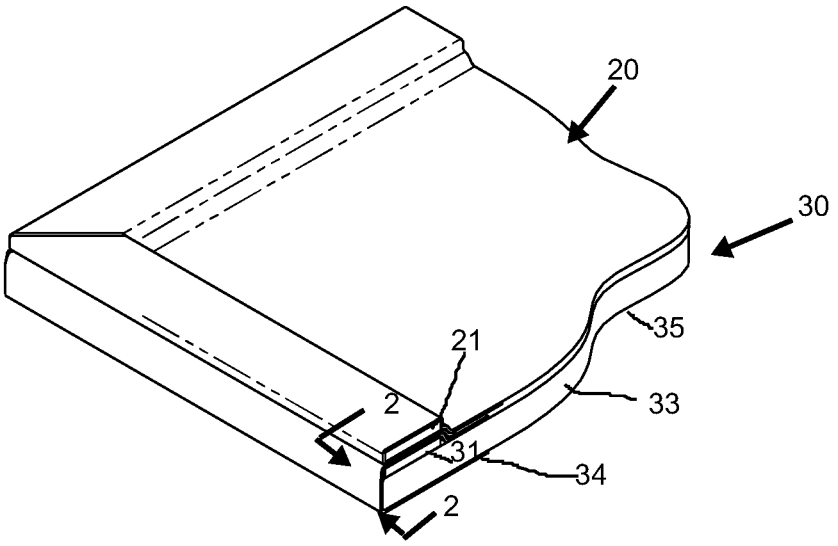
FIG. 1 is a partial cut away view of a yoga towel and mat in accordance with one aspect of the present invention.
Figure 2:
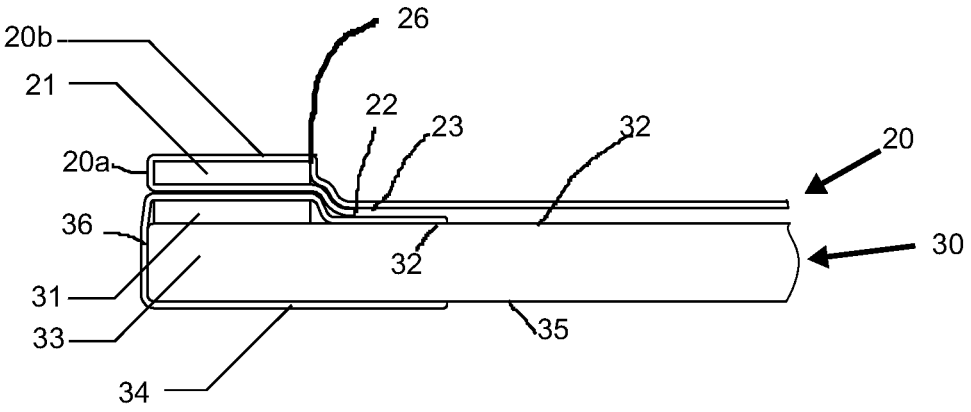
FIG. 2 is a cross-sectional view of the yoga mat and towel of FIG. 1 along line 2-2.
Figure 3:
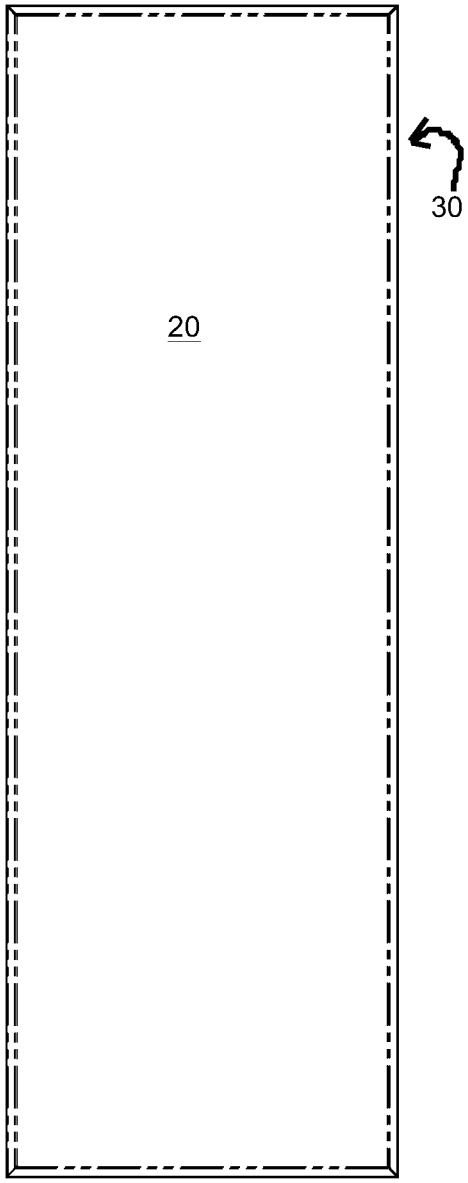
FIG. 3 is a top plan view of the yoga towel and mat of FIG. 1.

Referring now to the figures and in particular to FIGS. 1-3, in a first exemplary form, yoga towel 20 is magnetically held in place on yoga mat 30 due to magnetic attraction between a towel magnetic member 21 and a metal or magnet 31 in the mat 30. As best seen in FIG. 2, a perimeter or edge 22 of the towel 20 is folded over the towel metallic member 21 and then joined to a bottom surface 23 of the towel by stitching, an adhesive or other suitable material for permanently fixing the edge 22 to the bottom surface 23, and thereby form a pocket 26 with metallic member 21 disposed therein.

The metal or magnet 31 is disposed on a top surface 32 of the yoga substrate 33. A yoga mat fabric trim 34 is disposed over the metal or magnet 31 and is permanently fixed to the top surface 32 and bottom surface 35 by stitching, adhesive or other suitable material. The mat fabric trim 34 is therefore covering a portion of a top surface 32, a bottom 35 and side 36.

Advantageously, the towel magnetic member 21 and the metal or magnet 31 are covered with a waterproof material. An advantage of the waterproof coating is to preserve the magnetic member 21 and metal or magnet 31 from sweat and allow the yoga towel 20 to be washed for hygienic purposes. An example of material which can be used to produce the waterproof coating includes the materials sold as "Plasti Dip" by Plasti Dip International, 3920 Pheasant Ridge Drive, Blaine Minnesota 55449 herein incorporated by reference.

In use, one aligns the towel 20 with a perimeter of the yoga mat 30. The towel metallic member 21 is advantageously in the form of a magnetic strip which extends adjacent a perimeter of all four edges **20*a* of the rectangular towel 20. However, the metallic member 21** can extend along fewer edges, e.g., only two.

The metallic member 21 and/or the metal or magnet 31 can be composed of a flexible material which can be advantageous.

Figure 4:
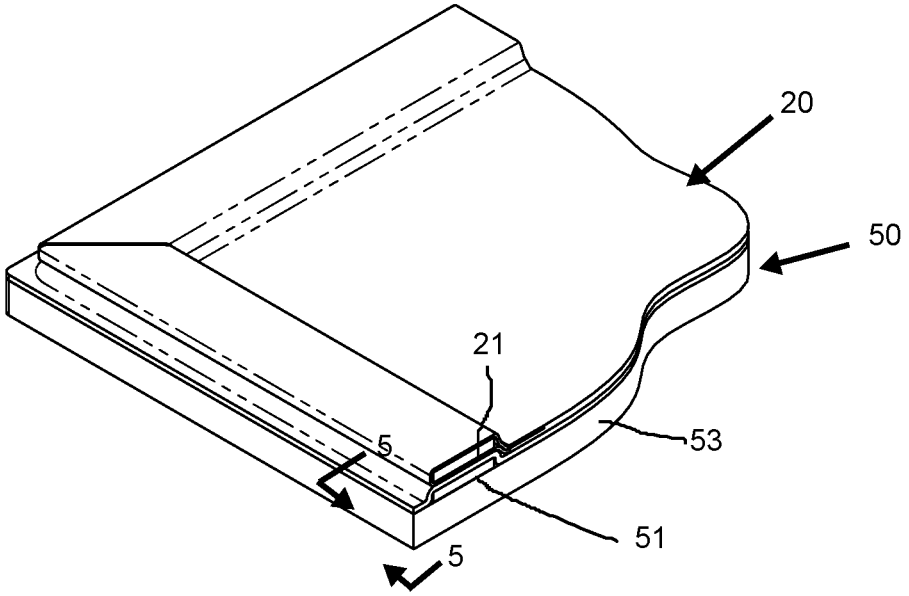
FIG. 4 is a partial cut away perspective view of a yoga mat and towel in accordance with another aspect of the present invention.
Figure 5:
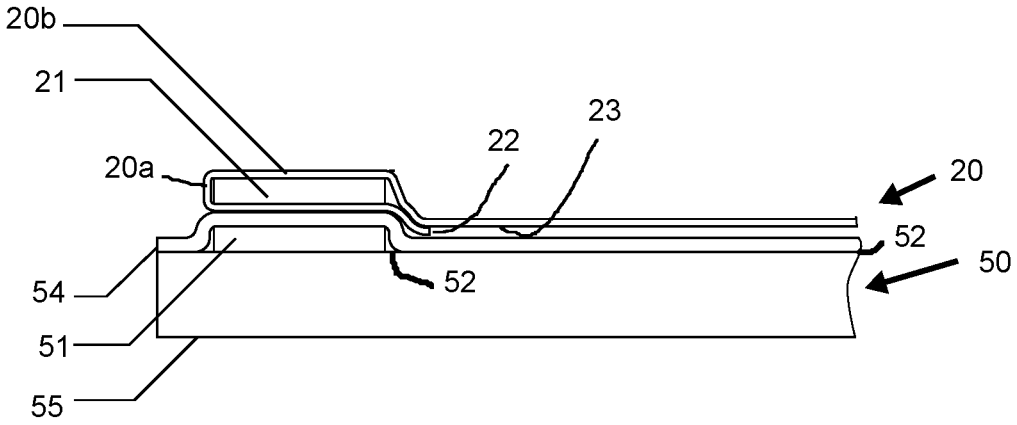
FIG. 5 is a partial cross section view taken along line 5-5 of FIG. 2.

Referring now to FIGS. 4 and 5, in an alternative embodiment, towel 20 can be used with a yoga mat 50. Metal or magnet 51 is disposed on yoga mat top surface 52 of substrate 53. A top laminate layer 54 is disposed over the metal or magnet 51 and top surface 52.

Figure 6:
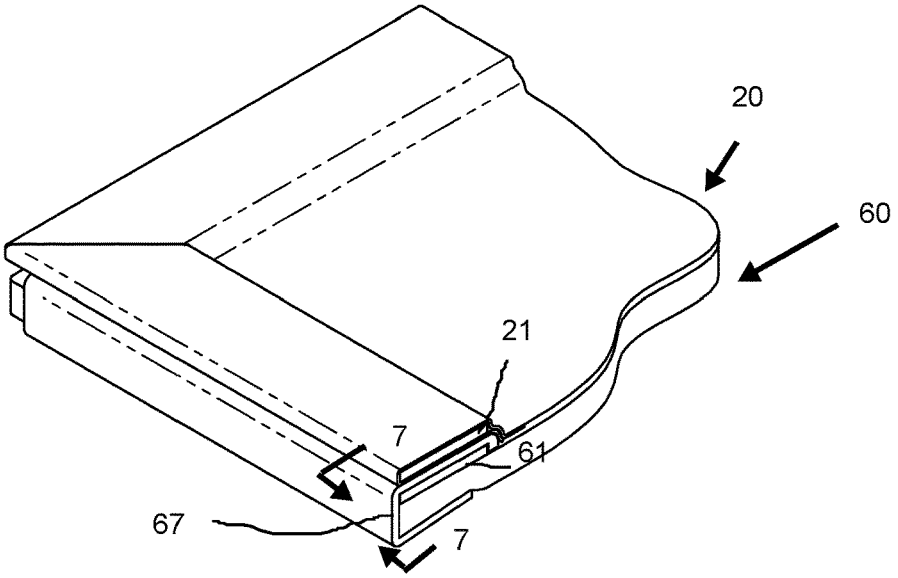
FIG. 6 is a partial cut away perspective view of yet another yoga and towel in accordance with another aspect of the present invention.
Figure 7:
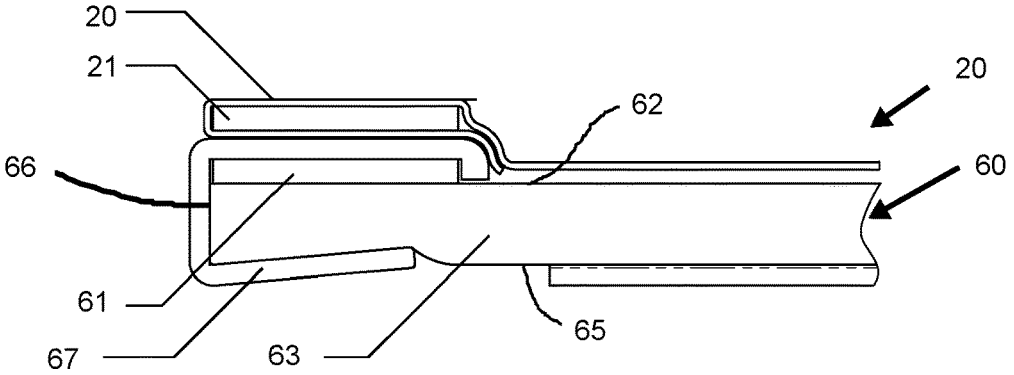
FIG. 7 is a cross section view taken along line 7-7 of FIG. 6.
Figure 8:
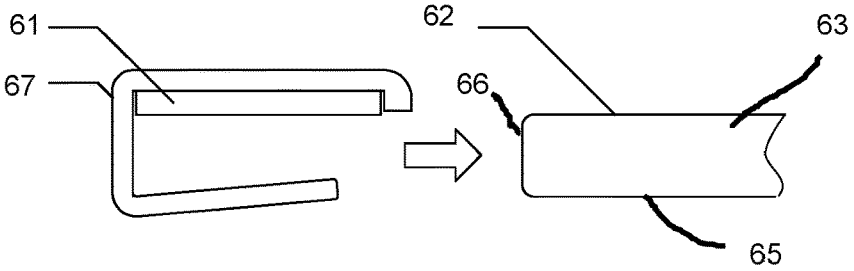
FIG. 8 is a sectional view showing placement of a clip on a yoga mat in accordance with one aspect of the present invention.

Referring now to FIGS. 6-8, yoga towel 20 can be used with yet an alternative yoga mat 60 which comprises a substrate 63 onto which metal or magnet 61 advantageously extends adjacent a perimeter of all four sides of the rectangular substrate 63. Yoga mat 60 is produced by retrofitting a conventional yoga mat 63 which acts as a substrate onto which one retrofits the magnetic strip 61.

Referring specifically to FIG. 8 along with FIG. 7, a mat edge clip 67 slides over a perimeter edge 66 of the mat 63 squeezing the mat 63 between top surface 62 and bottom surface 65. As with the above described mats 30, 40 and 50, the metal or magnet 61 need not extend adjacent all edges or perimeter sides of the rectangular mat in order to adequately hold the yoga towel 20 in place on the mat 60.

Figure 9:
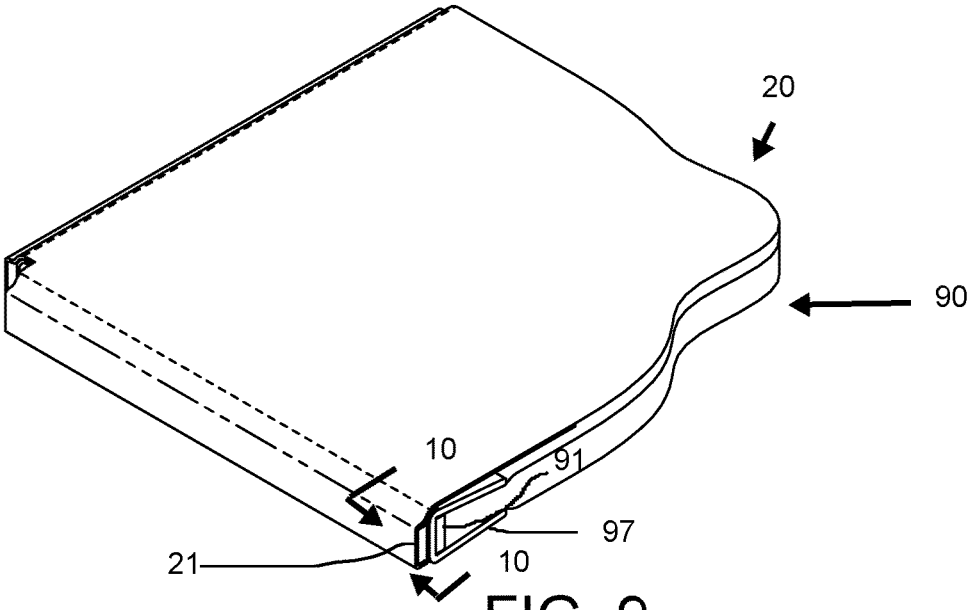
FIG. 9 is a partial cut away perspective view of still another yoga mat and towel in accordance with another aspect of the present invention.
Figure 10:
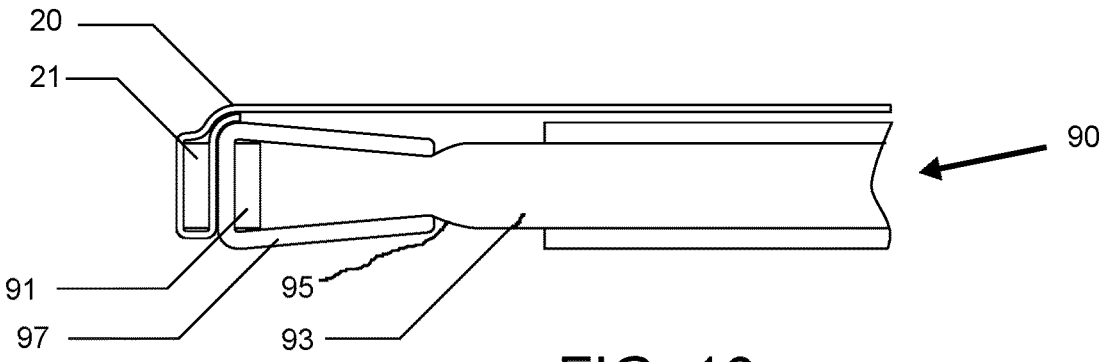
FIG. 10 is a sectional view taken along line 10-10 of FIG. 9.
Figure 11:
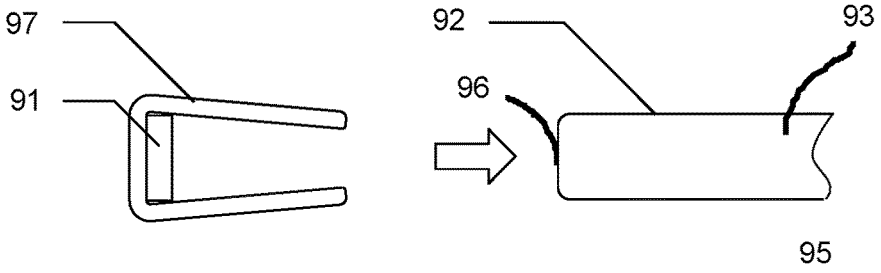
FIG. 11 illustrates attachment of a different clip to a mat in accordance with another aspect of the present invention.
Figure 12:
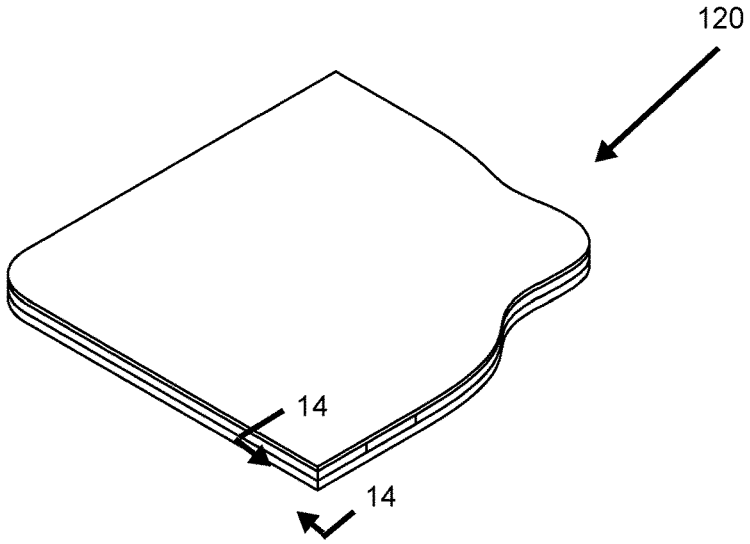
FIG. 12 is a partial cut away view of yet another yoga mat in accordance with the present invention.
Figure 13:
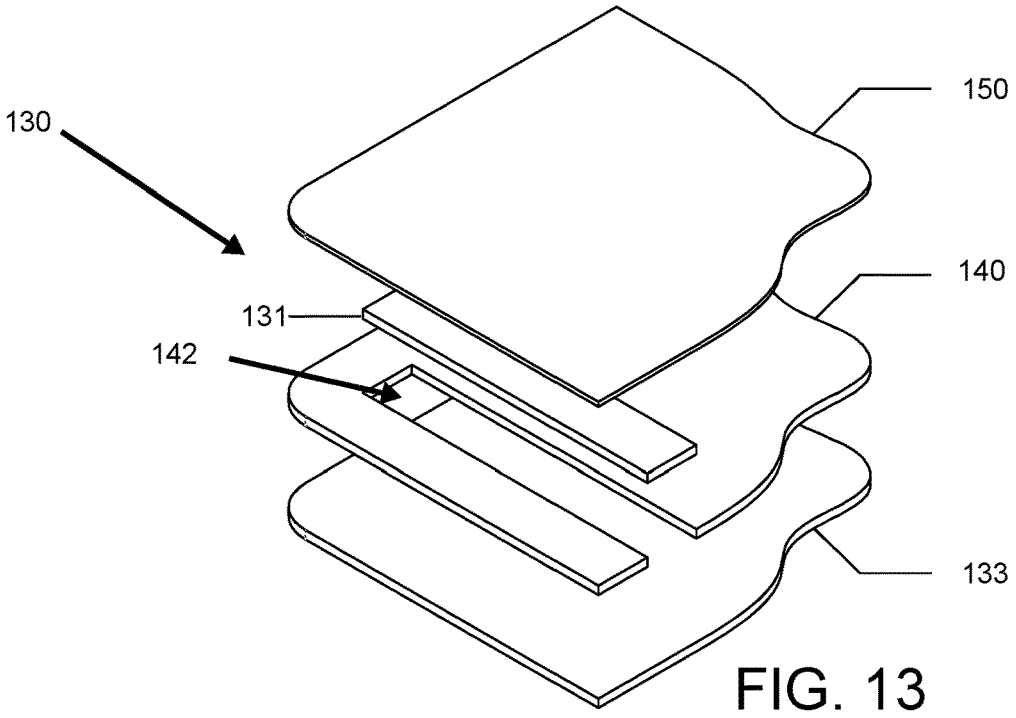
FIG. 13 is an exploded view of the yoga mat of FIG. 12.
Figure 14:
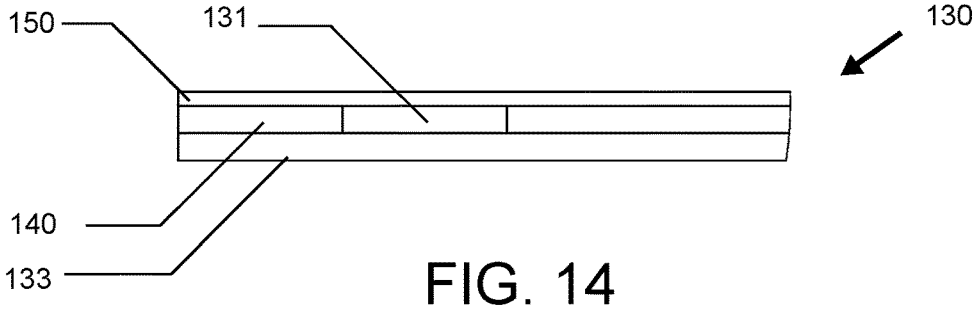
FIG. 14 is a cross section view taken along line 14-14 of FIG. 12.
Figure 15:
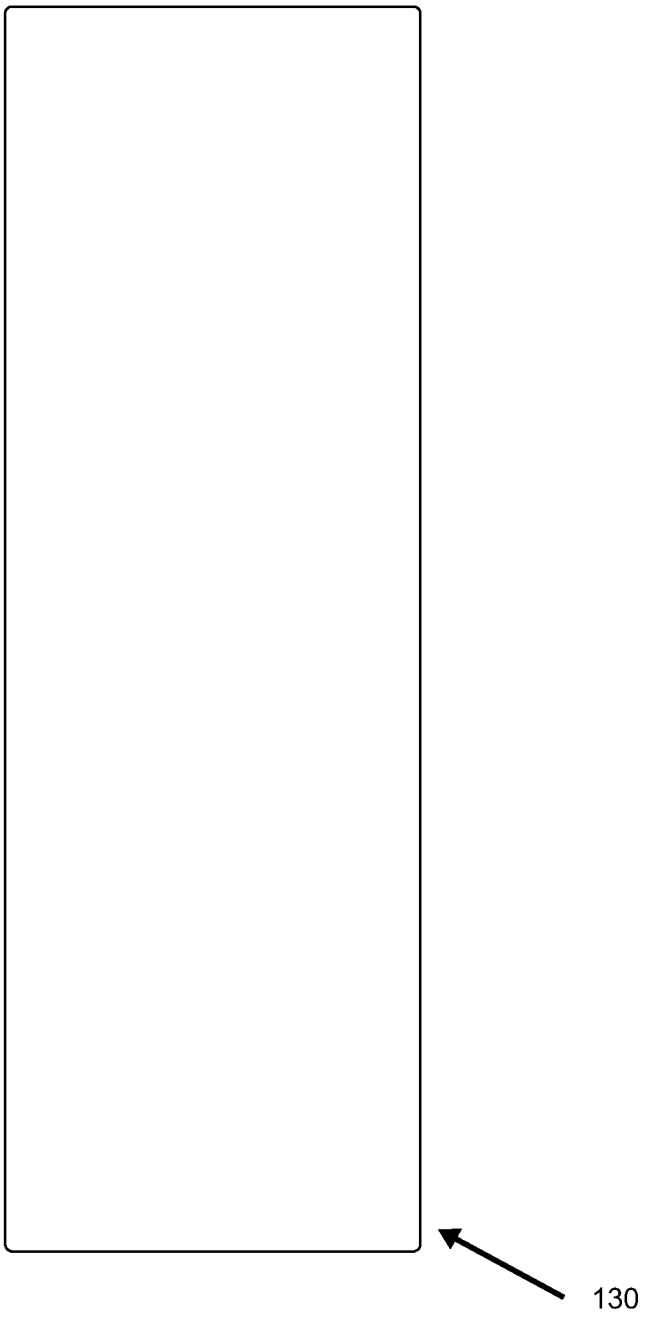
FIG. 15 is a plan view of an entire mat of FIG. 12.

Referring now to FIGS. 9-11, yoga mat 90 is produced by retrofitting a conventional yoga mat 93 using clip 97 (FIG. 11) which holds metal or magnet 91 in place along a perimeter side edge 96 of mat 93, by squeezing between top surface 92 and bottom surface 95. The yoga towel 20 is held in place due to magnetic attraction between the towel metallic member 21 and the metal or magnet 91.

Referring now to FIGS. 12-15, in yet another embodiment, yoga mat 130 comprises a substrate 133, a middle layer such as foam layer 140 and a top, non-slip rubber layer 150. The foam layer 140 has a recess or channel 142 into which one or more metal or magnet strips 131 is/are disposed. Advantageously, the magnetic strip 131 extends adjacent a perimeter of at least two sides and may include four sides of the rectangular mat 130.

Further advantageously, the substrate 133 is composed of a non-slip material. Further, advantageously the top layer 150 is composed of an anti-bacterial, non-slip rubber or similar suitable material. A suitable yoga towel with complementary metal and/or magnets such as yoga towel 20 is placed over the yoga mat 130 and held in place by magnetic force.

Figure 16:
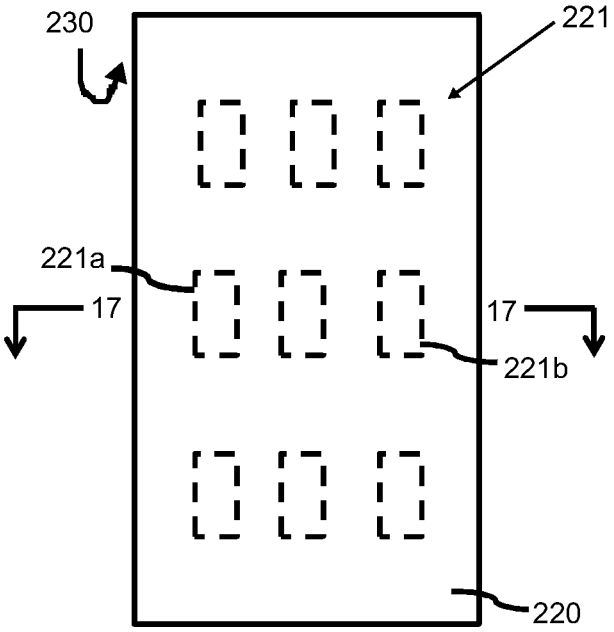
FIG. 16 is a top plan view of another yoga towel covering another yoga mat in accordance with the present invention.
Figure 17:
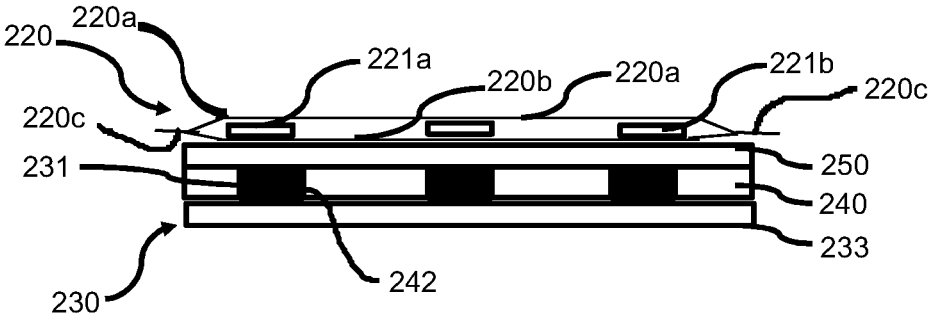
FIG. 17 is a cross section view of the yoga towel and yoga mat taken along line 17-17 of FIG. 16.

Referring now to FIGS. 16 and 17, in yet another form, yoga towel has a plurality of towel magnetic members 221 (e.g. 221*a*, 221*b*) spaced throughout the interior area of the yoga towel rather than just along the towel's perimeter. While depicted in FIG. 16 as nine towel magnetic members, any suitable number can be used as desired or needed for magnetically holding the yoga towel 220 to a suitable mat below.

Referring now specifically to FIG. 17, yoga towel 220 is composed of two layers, top layer 220*a* and bottom layer 220*b*. The towel magnetic members 221 (e.g. 221*a*, 221*b*) are disposed between top layer 220*a* and bottom layer 220*b*. The two layers come together at edges 220*c* and layers 220*a*, 220*b* are joined together, e.g. by sticking, adhesive or other suitable material or method. Optional sticking (not shown) around each of the magnetic member 221 (e.g. 221*a*, 221*b*) can be used to securely fasten the magnetic members 221 to the towel 220, between towel top layers 220*a* and bottom layer 220*b*.

In an alternative to having two layers 220*a*, 220*b*, in a manner shown in FIG. 17, other methods and techniques may be used for attaching the towel magnetic members 221 to the yoga towel including but not limited to sticking or adhering strips of material/fabric to a bottom surface of layer 220*a*, forming pockets into which the towel magnetic members 221 are disposed.

Yoga mat 230 is similar to yoga mat 130 in that it is composed of three layers, a bottom or substrate layer 233, a foam layer 240 and a top layer 250. Each of these layers can be composed of the same materials as those in yoga mat 130. The foam layer 240 has a series of recesses or channel 242 into which a respective magnetic strip 231 is disposed.

Figure 18:
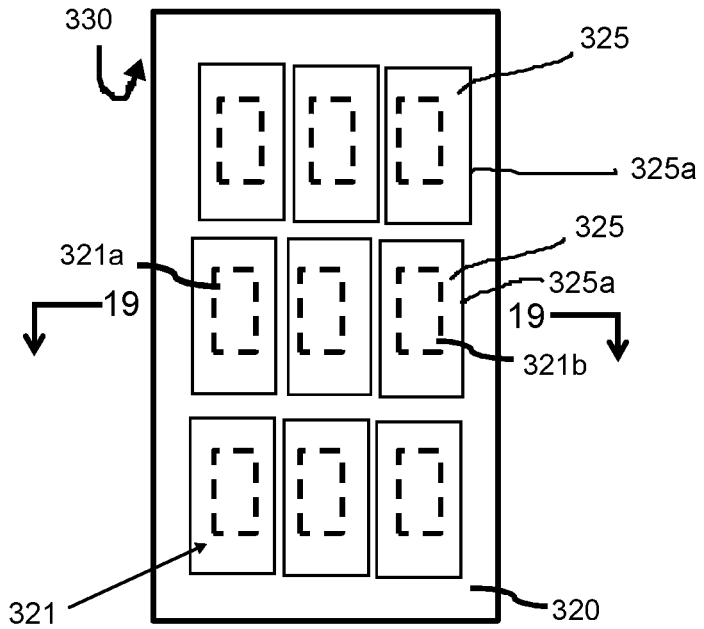
FIG. 18 is a top plan view of another yoga towel covering another yoga mat in accordance with the present invention.
Figure 19:
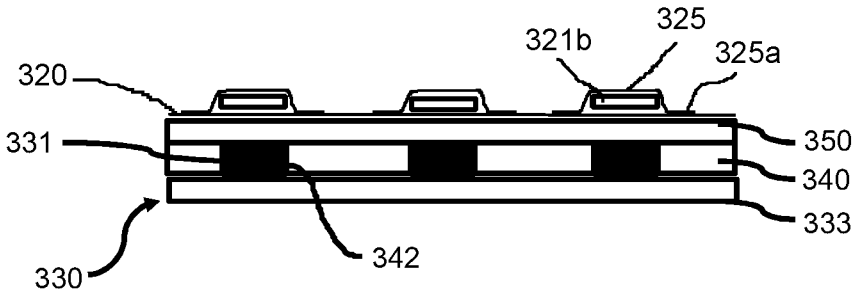
FIG. 19 is a cross-section view of the yoga towel and yoga mat taken along line 19-19 of FIG. 18.

Referring now to FIGS. 18 and 19, in still yet another form, the yoga towel 320 has a plurality of towel magnetic members 321 (e.g. 321*a*, 321*b*) throughout the interior area of the yoga towel 320 similar to yoga towel 220. However, the towel magnetic members 321 could be only along the perimeter of the towel. The towel magnetic members 321 are bonded to a surface of the towel 320 using a suitable adhesive which bonds the towel metallics member 321 to the towel 320. A separate piece of material 325 is disposed over the towel metallic members 321. The separate piece of material 325 is bonded to the towel 320 along its perimeter 325*a* thereby completely enclosing the towel metallic members 321 between the separate piece of material 325 and the material of the towel 320. As a result, the towel metallic members 321 are not exposed to the environment but enclosed completely between the fabric of the towel 320 and the separate piece of material 325. Optionally, the material 325 is also bonded to the towel metallic members 321. The yoga mat 330 (FIG. 19) is essentially the same as yoga mat 230 and therefore like elements to those of yoga mat 230 having increased by 100 as shown in FIG. 19 and not further described herein.

One of ordinary skill in the art will recognize that additional embodiments are also possible without departing from the teachings of the presently-disclosed subject matter. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and can be made without departing from the spirit and scope of the presently-disclosed subject matter.

Although the invention has been described with respect to a preferred embodiment, it is to be understood that the invention is capable of numerous modifications and variations, apparent to those skilled in the art, without departing from the spirit and scope of the invention.

What is claimed is:

1. A yoga towel and mat system, said system comprising:

i. a yoga mat comprising:

a unitary mat comprising at least a substrate layer, a middle layer and a top layer, the mat having a top surface, bottom surface and perimeter sides, the middle layer having a recess into which a metal or magnet is disposed, the metal or magnet embedded in the middle layer proximate the perimeter sides, whereby the metal or magnet is completely encapsulated within the unitary mat, and the substrate layer permanently attached to the middle layer, opposite the top layer, at least one of the substrate layer and the top layer being composed of a non-slip material; and ii. a yoga towel comprising:

a fabric towel composed of a fabric material; and a towel metallic member being ferromagnetic or magnetized, physically joined to the fabric towel, the towel metallic member being complementarily ferromagnetic or magnetized to be attracted to the metal or magnet permanently fixed to the yoga mat, a perimeter of the towel being folded back on itself, forming a pocket and the towel metallic member being disposed therein, wherein the fabric towel is held in place on the yoga mat due to the magnetic attraction between the towel metallic member and the metal or the magnet fixed to the yoga mat.

2. The yoga towel and mat system of claim 1, wherein at least one of the top layer and the substrate layer is composed of rubber or a rubberized material.

3. The yoga towel and mat system of claim 1, wherein both the top layer and the substrate layer are composed of a non-slip material.

4. The yoga towel and yoga mat of claim 3, wherein both the top layer and the substrate layer are composed of rubber or a rubberized material.

5. The yoga towel and yoga mat of claim 1, wherein the middle layer is a foam layer.

6. The yoga towel and yoga mat of claim 2, wherein the middle layer is a foam layer.

7. The yoga towel and yoga mat of claim 3, wherein the middle layer is a foam layer.

8. The yoga towel and yoga mat of claim 4, wherein the middle layer is a foam layer.

* * * * *